United States Patent [19]

Cassel

[11] Patent Number: 4,976,370

[45] Date of Patent: Dec. 11, 1990

[54] CONTAINER AND SEALING LID

[75] Inventor: Timothy S. Cassel, Boxborough, Mass.

[73] Assignee: Tucker Housewares, Inc., Leominster, Mass.

[21] Appl. No.: 464,525

[22] Filed: Jan. 12, 1990

[51] Int. Cl.[5] ..... B65D 43/06

[52] U.S. Cl. ..... 220/306; 220/355

[58] Field of Search ..... 220/306, 352, 355, 356

[56] References Cited

U.S. PATENT DOCUMENTS

| | | | |
|---|---|---|---|
| 4,165,020 | 8/1979 | Hoselton | 220/306 |
| 4,209,107 | 6/1980 | Crisci | 220/306 |
| 4,293,080 | 10/1981 | Letica | 220/306 |
| 4,296,871 | 10/1981 | Andersson | 220/306 |
| 4,520,943 | 6/1985 | Nielsen | 220/281 |
| 4,660,735 | 4/1987 | Peschardt et al. | 220/276 |

*Primary Examiner*—Gary E. Elkins
*Assistant Examiner*—Vanessa M. Roberts
*Attorney, Agent, or Firm*—Darby & Darby

[57] ABSTRACT

A container and complementary sealing lid both of which are of plastic, in which the container has a sealing bond on its wall around its upper peripheral edge of two different radii, the larger one on the outside, and the lid has a U-shaped peripheral sealing channel with inner and outer side walls and an upper wall joining the side walls. The inner surface of the upper wall is formed with areas of two different radii with the larger on the inner surface of the channel outer side wall and the container sealing bead and lid sealing channel being sized so that sealing engagement occurs between the bead and channel smaller radii areas and there is a clearance between the other parts of the bead and channel to aid in fastening and removing the lid.

9 Claims, 1 Drawing Sheet

CONTAINER AND SEALING LID

BACKGROUND OF THE INVENTION

The present invention relates to a container for storing food and liquids with a removable and replaceable lid capable of producing a tight seal. The container of the present invention is particularly directed for use in microwave cooking in which the container should be fairly strong so that it can hold a reasonable quantity of material and be placed into a microwave oven where it is subjected to RF energy from a source such as a magnetron.

The containers normally are plastic material, for example, polypropylene or polyethylene polymers and copolymers, and are fairly rigid although they may be subject to some amount of flexure. The lid provided must be capable of properly and effectively sealing the container to keep out ambient air. The lid must also be relatively easy to remove and replace since the container and lid are normally to be re-used.

A variety of container lid constructions are available, each of which has been designed to achieve the aforesaid goals or for a specific purpose or purposes. Most container lid combinations provide a sealing bead or rim around the container wall peripheral upper edge and a mating channel on the lid. The two fit together to produce the seal. Some lids are designed to be relatively elastic and flexible with a slow rate of recovery to provide a non-snapping and noiseless type of action when the lid is supplied to the container. Because of the use of plastic material having high flexibility to obtain a non-snapping lid, its difficult with such a construction to provide a tight seal especially under conditions where the container is refrigerated. Moreover, if the lid has a recessed top wall, this reduces the capacity of the container for storing foods. Such an arrangement is shown in U.S. Pat. No. 2,487,400.

Another type of container lid, such as shown in U.S. Pat. No. 4,471,880 to Tagle, uses a snap action by providing a cantilever type construction between the medial lid portion and the sealing channel on its periphery combined with a special shape for the container sealing bead. However, such an arrangement may not provide an effective seal after extended use due to the dimensional changes between the bead and the sealing channel.

One desirable material to use for such container is a polypropylene copolymer which can be produced in a clear transparent version. This material is desirable since it is relatively rigid and, being transparent, it permits the user to view the contents of the container during the time that it is in the microwave oven. It would be also desirable to use this material for the lid since it would provide better structural rigidity for the container lid combination and also permit a clear view of the container contends through the lid. However, such a material has a problem in that it is relatively stiff and inflexible. Thus, some effective way must be found to provide an effective seal using a relatively stiff and rigid material for the lid. This is why, in many prior art containers/lid combinations, the lid is often made of more flexible material than the container.

BRIEF DESCRIPTION OF THE INVENTION

The present invention is directed to a plastic container and sealing lid in which both are constructed of the same material and an arrangement as provided to form an efficient seal even though the lid material is relatively stiff. More particularly, the container, which can be of any desired shape such as rectangular, square or round, has a sealing bead on the periphery of its upper edge. The bead has an oblate surface formed by two different size radii, continuing into a rounded outer peripheral surface and thereafter a substantially flat section tapering downwardly into the container wall.

The lid has a planar medial portion extending above the container top so that the contents in the container can extend above its top edge. A U-shaped piece attached to the medial portion transposes into an inverted U-shaped sealing channel having an inner and outer wall. The inner surface of the inner wall of the sealing channel is generally flat to correspond with the inner wall of the container and the inner surface of the channel outer wall has a shoulder. The upper part of the channel has a sealing section of two curved parts of different radii.

The lid is pressed over the container sealing bead with the bead's rounded surface riding over the shoulder of the sealing channel outer wall and fitting into the recess with a clearance between both the inner and outer walls of the sealing channel. Sealing is accomplished against the inner surface of the upper wall of the lid sealing channel where the upper edge of the bead, primarily at an extension of the center line of the container wall on which the bead is formed and where the radii change, engages the inner face of the sealing channel sealing section of two different radii.

The container as well as the lid can be made of a relatively stiff plastic material as is necessary to withstand the rigor of transition from refrigerator and freezer to microwave oven. Also, the lid can be easily taken off and applied back onto the container since there is the clearance between the container sealing bead and the side walls of the lid sealing channel. No snap action is needed. An effective seal is obtained because the bead sealing area is on the container wall center line and substantial pressure is exerted between the engaging surfaces of the bead and sealing channel wall.

OBJECTS OF THE INVENTION

It is therefore an object of the invention to provide a container with a removable sealing lid.

Another object is to provide a container with a sealing lid having an effective sealing action.

A further object is to provide a container with a sealing bead around its periphery and a lid having a sealing channel with the bead having a clearance between the channel side walls and sealing is effected between the top of the bead and the surface of the sealing channel upper wall whcih is of a shape corresponding to the sealing bead.

An additional object is to provide a sealing arrangement for a container/lid combination which are made from the same, relatively stiff, material in which the sealing action takes place at an interface of the upper edge of the container sealing head and the lid sealing channel along the center line of the container wall at a point where the bead has a smaller radius than the remainder of the bead.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
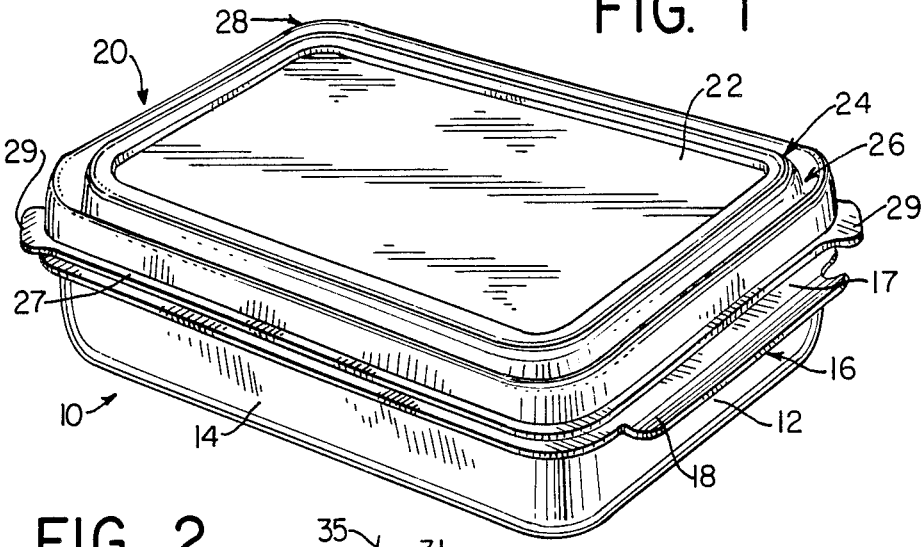
FIG. 1 is an overall perspective view of the container with the lid thereon.

Referring to the drawings, FIG. 1 shows the container 10 as being of generally rectangular shape although any other suitable shape can be utilized. The container has upwardly sloping end walls 12 and side walls 14 extending from a bottom wall 15. The opposing end walls 12 each have an outwardly extending shelf 16 used to hold the container. As shown in greater detail in FIG. 2, the shelf 16 is formed by a portion of a peripheral flange 17 which is relatively flat and extends around the walls of the container. The shelf has an outer section 18 which is curved for gripping convenience purposes.

The container bottom wall 15 also has (see FIG. 2) a rib 19 which extends around the bottom wall inwardly of the outer edge thereof. The rib 19 can be continuous or interrupted as desired. The container can be placed on any surface resting on the rib 19.

The container is preferably molded from a suitable material such as a polypropylene, copolymer which is relatively stiff and which is visually clear. The bottom and side walls of the container can have a thickness, for example, of about between 0.050 to 0.060 inches. The thickness depends upon the overall size of the container with thicker material being used for larger containers.

Figure 2:
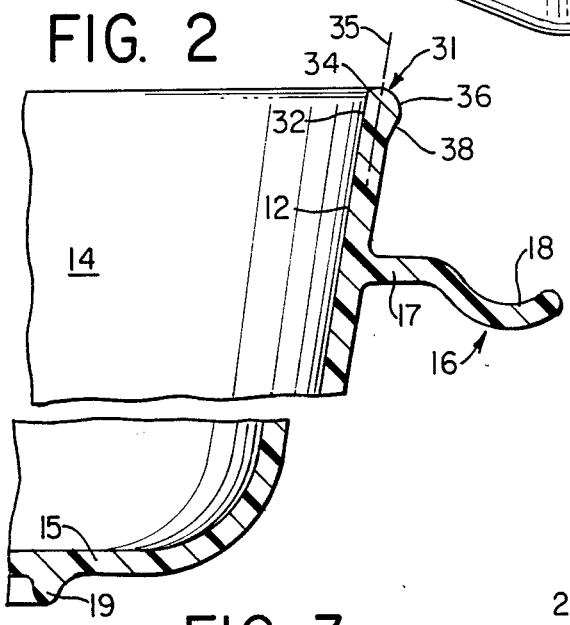
FIG. 2 is a fragmentary view in cross section showing a portion of the wall of the container.
Figure 3:
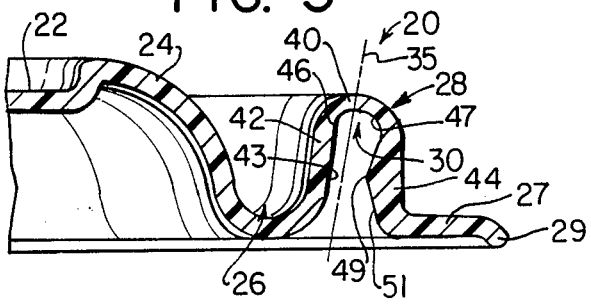
FIG. 3 is a fragmentary cross sectional view of a portion of the lid showing the sealing channel.

A lid 20 is provided which has the same general outer shape as the upper peripheral edge of the container. The lid has a raised medial portion with a central depressed planar area 22, the latter being primarily for stacking. As seen in the superposition of FIGS. 2 and 3, the rib 19 on the container bottom wall will fit into the depressed medial area 22. The depressed medial area 22 is at a higher level than the upper extremity of the container walls 14, 12 to increase the volume of the contents which can be held when the lid is in place.

The lid has a connecting transition section 24 which is attached to and surrounds the medial portion 22. The connecting section 24 first extends upwardly and then tapers downwardly from the depressed medial section 22 and thereafter extends upwardly into a U-shaped channel 26. The upwardly extending wall of the channel 26 forms the inner wall 43 of the lid sealing portion 28 which has an inverted U-shaped sealing channel 30 as described in greater detail below.

The lid also has a peripheral flange 27 extending outwardly from the peripheral sealing portion 30. The peripheral lid flange 27 lies opposite to but spaced from the container peripheral flange 17. A tab 29 extends from one or more corners of the lid flange 27 to aid in removal of the lid from the container.

Referring now to FIG. 2, on the upper end of the container walls 12, 14 is a peripheral sealing bead 31. The inner face of the bead 31 is coextensive with the inner surface of the wall 12, 14 and is, therefore, flat as shown at 32. The bead 31 has an upper rounded portion 34 which is part of a first radius looking from the point of view of the center line 35 of the container wall. Thereafter, the outer surface of the bead 31 is also formed by a rounded portion 36 of a second radius which is larger than said first radius rounded portion 34. The change of the radius from 34 to 38 is approximately at the container wall center line 35. Extending from the lower end of the larger radius rounded portion 36 is a substantially flat tapered section 38 which extends inwardly into the outer surface of the slightly outwardly inclined walls 12, 14.

As should be apparent from viewing FIG. 2, the sealing bead 31 is not uniform. The upper portion 34 of smaller radius relative to the center line 35 of the container wall is, as explained below, primarily used to form the sealing action.

Referring to FIG. 3, the details of the lid sealing channel 30 are now discussed. The sealing channel is formed as part of the lid generally of an inverted U-shape having an inner side wall 42 and an outer side wall 44 which are formed by an upper wall 40. The center line 35 of the container wall is shown for reference purposes relative to the upper wall 40 of the lid sealing channel 30.

The inner surface 43 of the sealing channel inner wall 42 is flat and is generally parallel to the inner surface of the container wall 12, 14. As discussed below with respect to FIG. 4, the lid sealing channel is forced so that there is a clearance between the inner surface 43 of the sealing channel inner wall and the inner surface 32 of the container lid wall.

The inner surface of the sealing channel upper wall 40 has a shape substantially corresponding to that of the curved portions 34, 36 of the container sealing bead 31. More specifically, it is formed by two different radius curves 46 and 47, with the radius 47 being larger than 46. Thereafter, there is an inwardly extending shoulder 49 and a wall section 51 which tapers outwardly relative to the container wall.

Figure 4:
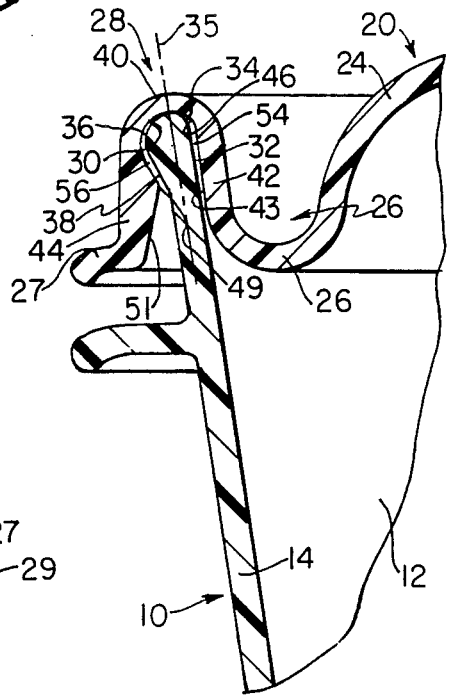
FIG. 4 is a fragmentary view in cross section showing the lid fastened to the container.

FIG. 4 shows the lid with its inverted U-shaped sealing channel 30 attached to the container. As seen, there is a clearance 54 between the surface 43 of the sealing channel inner wall 42 and the inner surface of the container wall. The sealing channel outer wall 44 is also formed to provide a clearance space 56 between the container sealing bead outer surface and the inner surface of lid wall 44. The clearance 56 begins at the larger radius rounded part 36 of the container sealing bead.

As seen in FIG. 4, the sealing occurs primarily between the smaller radius curved portion 34 of the container sealing rim and the smaller radius curved portion 46 of the lid sealing channel. The sealing action takes place along the container wall center line 35 against the lower surface of the smaller radius sealing channel curved part 46.

The thickness of the container lid is equal to or somewhat less than that of the container, for example, of about 0.050". The lid thickness is uniform except at two locations. The first is on the inner surface of the outer wall 44 of the sealing channel in the area of the shoulder 49 where the thickness is about 0.085 inches tapering back to the standard thickness above and below the shoulder. The second is the area at the extension of the container wall center line 35 of the sealing channel upper wall 40 where the lid is of reduced thickness, say about 0.035" taping back gradually to the standard quarter thickness on each side of the center line 35.

The combination of the increased thickness shoulder area 49 and the reduced thickness area of the sealing channel upper wall has an advantage. The thicker shoulder area provides increased rigidity for the sealing channel outer wall 44 to ride over the bead 31 while at the same time the reduced thickness area of the sealing channel upper wall provides somewhat greater flexibility for the entire sealing channel to ride over the bead 31. This combination aids in both applying the lid to and removing it from the container.

Also, during manufacture of the lid it is desired to use a fast cycle time. The lid can be ejected from the injection molding machine with the thicker sealing channel outer wall 44 not yet being fully loaded. As the thicker portion cools, it pulls wall 44 slightly inwardly towards the center line, thereby narrowing the sealing channel 30. This movement occurs at the thinner part of the upper wall which acts like a hinge both during manufacture and during the use of the lid.

In operation, the lid is laid over the surface of the container and is pressed downwardly primarily on the medial portion 22 and the peripheral sealing area 28. The space between the outwardly inclined inner surface 51 of the sealing channel outer wall 44 and the inner surface of the sealing channel inner wall 42 provides easy entranceway of the container sealing bead into the lid sealing channel. Further pressure on the lid periphery causes the bead larger diameter rounded portion 36 to ride over the shoulder 49 on the inner face of the sealing channel outer wall as the channel flexes about the reduced thickness part of the upper wall.

As the lid is forced downwardly on the container, the two clearances 54 and 56 between the container sealing bead out and inner surfaces and the corresponding surfaces of the lid sealing channel provide easy attachment since there is no interference between them. The downward motion of the lid is continued until the sealing bead rounded top surface 34 engages the rounded inner surface 46 of the sealing channel. As seen in FIG. 4, the sealing action starts at the extension of the container wall center line 35 and for a distance inwardly between the rounded surfaces 34, 46. Since the main seal is along the wall center line, this provides an effective seal since the area whence the seal is formed on the sealing channel is generally transverse to the container wall center line. Thus, pressure applied to the lid in the sealing area causes a firm engagement with the effective sealing area 34 on the top surface of the bead.

To remove the lid, the user grasps one of the extending lid tabs 29 and pulls upwardly. The lid is effectively peeled off the container sealing lid. Here also, the presence of the clearances 54, 56 make the lid easier to remove, even though it is of relatively stiff material. The sealing channel shoulder 49 is pulled over the rounded part 36 of the container sealing bead. This action is enhanced by the flexing of the sealing channel at the reduced thickness part of the upper wall.

As seen, a novel and effective arrangement has been provided for sealing a lid to a container where the two are made of a relatively stiff material.

I claim:

1. The combination of a container having an open top and a lid for sealing said open top comprising:

a container with a bottom wall and an upwardly extending continuous wall extending therearound said container having a sealing bead around the upper peripheral edge of the wall, said sealing bead having an outer surface formed of two curved areas of different radii relative to the center line of the wall with the area of larger radius facing the outside of the wall, a lid of the same general overall shape as the upper peripheral edge of the container, said lid having a downwardly extending generally U-shaped sealing channel for mating with the container sealing bead, said lid sealing channel having outer and inner side walls joined by an upper wall each having inner surfaces, the inner surface of the lid sealing channel upper wall between the inner surfaces of the inner and outer walls formed of areas of two different radii with the larger radius area being adjacent the inner surface of the channel outer side wall, said container sealing bead and said sealing channel sized so that the sealing occurs on the part of the sealing bead and sealing channel radii of smaller diameter and there is a clearance between all other parts of the sealing bead and sealing channel to aid in fastening the lid to and removing it from the container.

2. The combination of claim 1 wherein the transition of the two different radii of the sealing bead occurs at an extension of the enter line of the container wall thickness.

3. The combination of claim 2 wherein the point of sealing of the bead and the channel begins at approximately said extension of the center line of the container wall thickness and continues inwardly along said bead and channel smaller radii.

4. The combination of claim 1 wherein the lid further comprises a shoulder on the mid part of the inner surface of the sealing channel outer side wall below the curved section of larger radius to ride over the outer surface of the container sealing bead.

5. The combination of claim 4 wherein the portion of the lid sealing channel outer wall below said shoulder flares outwardly to provide an entrance way for the sealing bead into the sealing channel.

6. The combination of claim 2 wherein the container wall is outwardly inclined from the vertical relative to the container bottom wall.

7. The combination of claim 1 wherein the container and the lid are formed of a relatively stiff polypropylene copolymer.

8. The combination of claim 2 wherein the upper wall of the sealing channel has a reduced thickness in the area of the container wall center line extension to increase the flexing of the sealing channel as it is applied over the container bead.

9. The combination of claim 4 wherein the upper wall of the sealing channel has a reduced thickness in the area of the container wall center line extension to increase the flexing of the sealing channel as the shoulder on the inner surface of the sealing channel outer wall rides over the container sealing band.

* * * * *